United States Patent [19]

Kleeb

[11] 4,383,144

[45] May 10, 1983

[54] PUSHBUTTON SWITCH

[75] Inventor: Markus Kleeb, Reinach, Switzerland

[73] Assignee: Tschudin & Heid AG, Switzerland

[21] Appl. No.: 226,594

[22] Filed: Jan. 21, 1981

[30] Foreign Application Priority Data

Jan. 25, 1980 [CH] Switzerland ..... 600/80

[51] Int. Cl.[3] ..... H01H 9/26

[52] U.S. Cl. ..... 200/5 R; 200/159 R; 200/314

[58] Field of Search ..... 200/5 R, 6 R, 6 A, 5 B, 200/5 C, 5 E, 16 A, 153 J, 159 R, 307, 314, 328, 153 L, 153 LA

[56] References Cited

U.S. PATENT DOCUMENTS

| | | | |
|---|---|---|---|
| 2,875,287 | 2/1959 | Van Sickle | 200/153 T X |
| 3,404,244 | 10/1968 | Amis, Jr. et al. | 200/159 R X |
| 3,488,611 | 1/1970 | Harper | 200/153 LA X |
| 3,509,300 | 4/1970 | Hipple | 200/313 |
| 4,104,494 | 8/1978 | Swann | 200/67 G |
| 4,112,277 | 9/1978 | Kleeb | 200/153 J |

FOREIGN PATENT DOCUMENTS

| | | |
|---|---|---|
| 1440869 | 4/1969 | Fed. Rep. of Germany . |
| 2028499 | 11/1973 | Fed. Rep. of Germany . |
| 547542 | 3/1974 | Switzerland . |
| 607858 | 11/1978 | Switzerland . |

OTHER PUBLICATIONS

"Swisstac" Prospectus (Aumann), Switzerland, 3 pp.

*Primary Examiner*—J. R. Scott
*Attorney, Agent, or Firm*—McGlew and Tuttle

[57] ABSTRACT

A pushbutton switch has a plunger guide housing in which a plunger is displaceably guided and on which control elements are detachably mounted on different sides of the plunger axis. Each control element is pushed onto a guide extending parallel to the direction of motion of the plunger and is held by a locking bolt which is rotatably mounted in the plunger guide housing. In each control element housing is mounted a spring-loaded actuator for displacement transverse to the direction of motion of the plunger, so that it can be moved by pressing the plunger from a rest position into a working position. This design has the effect that the forces produced primarily by the return springs of the actuators and transmitted over the actuators in their working position, do not exert a great force on the plunger extending parallel to the direction of motion of the plunger.

11 Claims, 7 Drawing Figures

PUSHBUTTON SWITCH

FIELD AND BACKGROUND OF THE INVENTION

The present invention relates to switches in general and, in particular, to a new and useful pushbutton switch which includes a movably mounted plunger that engages and moves actuators. While the plunger and actuators both include position-restoring springs, the arrangement is such that the combined forces of the springs do not apply directly to the plunger to restore its position.

Pushbutton switches, which are known from U.S. Pat. No. 4,112,277 and Swiss Patent No. 607,858, have a plunger guide housing in which a plunger can be manually moved in an axial direction against the force of a return spring. At least one switch or control element with a switch or control element housing is secured by screws on the plunger guide housing which contains at least one moving contact. If several control elements are provided, these are arranged in series in the direction of motion of the plunger, with which the moving contacts can be brought from one switching position into another switching position. The actuators are designed so that, in the case of several control elements, the actuator of one control element can displace the actuator of the respective following control element.

The control elements are designed substantially according to Swiss Patent No. 547,542. A return spring acts on the actuator which presses the actuator against one end position, which will here be called the "rest position". By pressing the plunger by hand, the plunger can move the actuator from one end position, namely, the rest position, against the force of the return spring into its other end position, namely, the working position.

When the plunger is pressed and the actuator of the control element or the actuators of the control elements are in their working positions, different forces extending in the direction of motion of the plunger act on the plunger. One of the forces acting on the plunger is the force produced by the plunger-return spring proper which acts directly on the plunger. To this force is added the force exerted by the return spring of the control elements or the return springs of the control elements on the plunger over the actuator or actuators. The total force acting on the plunger in the working position in its direction of motion is thus increased by the control elements, and depends on their number. If the actuators are to be held in their working position, the forces exerted by the return springs on the plunger must naturally be compensated by a corresponding counter-force, whose size depends on the number of control elements. This is a disadvantage which is of particular importance when the pushbutton switch, e.g., according to the above-mentioned U.S. Pat. No. 4,112,277, is designed as a locking switch, because the locking element retaining the plunger in the locked position must then absorb the entire restoring force acting on the plunger.

In the switches known from U.S. Pat. No. 4,112,277 and Swiss Patent No. 607 858, the soldered connections are arranged on the sides of the control elements, which is unfavorable for various applications. These switches have further the disadvantage that the changing of a control element requires the unscrewing and screwing of screws which is relatively tiresome and time consuming.

In other known switches, where the control elements are secured by screws on the plunger guide housing, the switches can only be mounted on a switchboard or on the front panel of an apparatus after the control elements have been disassembled. When these switches are installed, additional screws are required, in addition to the preassembled parts containing the plunger guide housing, the plunger, and the control elements, for securing the element, which must be made available and be screwed on. The installation and the final assembly of the switches are thus more complicated, and the expenditure of time and energy increases, which is likewise a considerable disadvantage.

SUMMARY OF THE INVENTION

The object of the present invention is to provide a pushbutton switch where the force acting on the plunger in the working position of the actuator or actuators parallel to the direction of motion of the latter is relatively small or non-existent.

Accordingly, another object of the invention is to provide a pushbutton switch with a plunger guide housing, a plunger movable in the guide housing, at least one control element which has a control element housing, at least one moving contact in the control element and a movable actuator in the control element for moving the moving contact, at least one restoring spring associated with the actuator to restore its position after the plunger has moved the actuator, the plunger engageable with the actuator to move the actuator in a direction substantially transverse to the motion of the plunger.

In a particularly advantageous design of the pushbutton switch, dovetail guides are provided on different sides of the plunger parallel to its direction of motion, on each of which can be pushed one control element. A bolt extending along the longitudinal axis of the plunger which is held in the plunger housing for rotation, but only limited axial movement, has a radial projection for each control element. The bolt can be brought from one rotary position in which the control elements can be displaced along the guides, into another rotary position in which its projections lock the control elements and hold them immovably. This makes it possible to secure the control elements on the plunger guide housing without the use of screws, by a slight rotation of the bolt forming a central lock.

A further object of the present invention is to provide a pushbutton switch which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
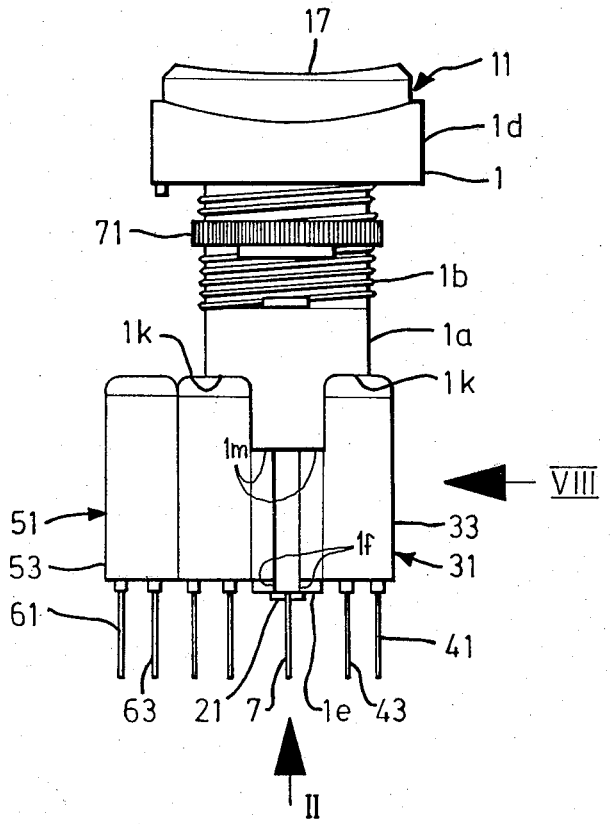
FIG. 1 is a side elevational view of a pushbutton switch, constructed in accordance with the present invention.
Figure 2:
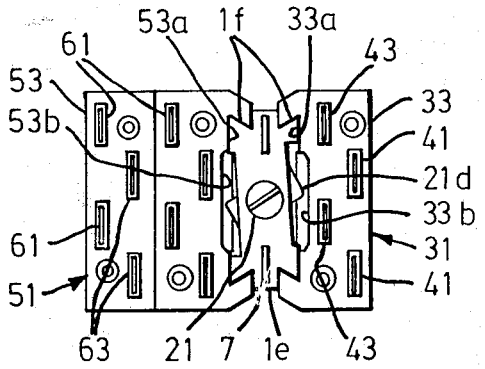
FIG. 2 is a bottom plan view in the direction indicated by arrow II in FIG. 1, where the locking bolt is shown in an intermediate position.

Turning to the drawings in particular, the invention embodied therein, in FIG. 1, comprises, a pushbutton switch, having a plunger guide housing 1, in which a plunger 11 is movable in one direction to move actuators of control elements 31 and 51 in a substantially transverse direction.

Figure 3:
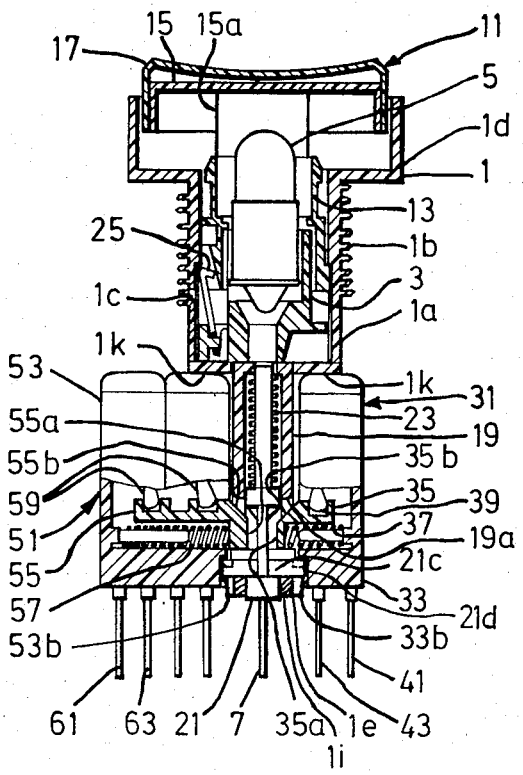
FIG. 3 is a sectional view through the switch along the longitudinal axis of the plunger with the plunger in its rest position.

The pushbutton switch shown in FIGS. 1 to 4, has a plunger guide housing 1 consisting of welded plastic parts with a sleeve 1*a* which is provided over a part of its length with a male thread 1*b* and also with at least one lateral slot-shaped opening 1*c* (FIG. 3). At one end of the sleeve 1*a*, housing 1 is provided with a rectangular dish 1*d*. The other end section 1*e* of housing 1, which has the form of a prism with a generally rectangular cross-section, forms together with sleeve 1*a*, two shoulders 1*k*. Section 1*e* of housing 1 is provided, on two rectangular sides, arranged on different sides of the longitudinal axis of housing 1, facing away from each other, with dovetail guides 1*f* extending parallel to the longitudinal axis of the housing. Stop shoulders 1*m* are provided at the ends of the dovetail guides 1*f* adjacent to the dish 1*d*. The end section 1*e* is provided with an opening 1*g* extending along the longitudinal axis of the housing, which breaks through its walls in the two wider rectangular sides and dovetail guides 1*f*, and form an oblong slot extending up to web 1*i*, as can be seen particularly clearly from FIG. 8. The end section is therefore subdivided by the opening 1*g* into two legs, joined at their rear end by the web 1*i*. Opening 1*g* is provided with an extension 1*h* on one side in the range of the wider rectangle sides.

A lamp socket 3, into which a lamp 5 is inserted, is also secured inside of housing 1. The electrically conductive parts of the lamp socket are provided with terminals 7 which project from the end of housing 1 remote from dish 1*d*.

Figure 4:
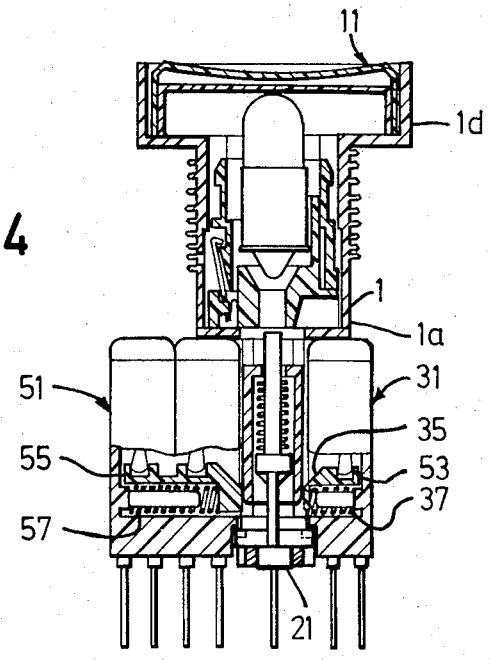
FIG. 4 is a sectional view similar to FIG. 3, but with the plunger pressed down.

A plastic plunger, generally designated 11, is guided in plunger guide housing 1 along the longitudinal axis thereof. Plunger 11 has a sleeve 13 arranged in sleeve 1*a*. On its end, which is at the top in FIGS. 1, 3 and 4, is mounted a detachably transparent pushbutton 15 which is provided with catches 15*a* on which, in turn, a transparent cap 17 is placed. Pushbutton 15 and cap 17 are partly or completely inside dish 1*d*, depending on the switching position. At one end of sleeve 13, which is at the bottom in FIGS. 1, 3 and 4, a sleeve 19, provided with catches, is secured. At its free end 19*a*, which also forms the end of plunger 11 remote of pushbutton or knob 15, on the outsides facing away from each other 19*a* is provided with convex transition faces in the direction of motion of the plunger, which are thus inclined toward the direction of motion of the plunger, that is, the longitudinal axis of plunger guide housing 1 and plunger 11 in a variable angle along the direction of motion of the plunger.

Figure 5:
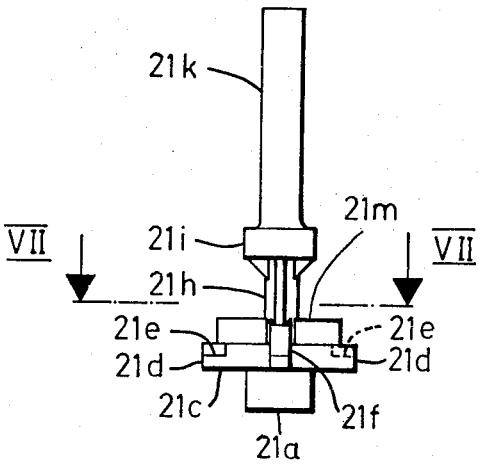
FIG. 5 is, on an enlarged scale, a side elevation view of the locking bolt for locking the control elements.
Figure 6:
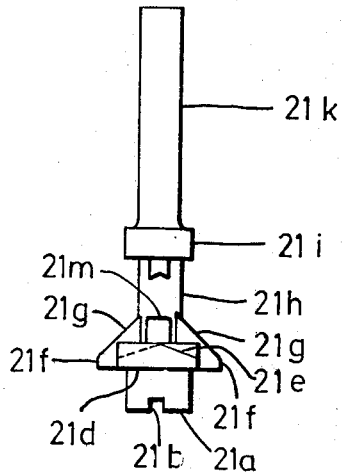
FIG. 6 is a side elevation view of the locking bolt, turned 90° relative to FIG. 5.
Figure 7:
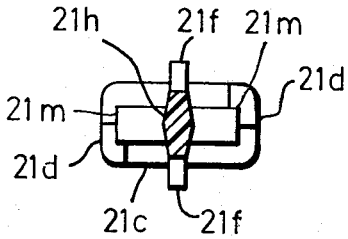
FIG. 7 is a top plan view of one end face of the locking bolt.

A plastic locking bolt or element 21, represented separately in FIGS. 5, 6 and 7, has at one end a head 21*a* with a slot 21*b* for a screwdriver. Head 21*a* is adjoined by a section 21*c*, which has substantially the form of a T-beam. The T-beam adjoins head 21*a* and forms two projections 21*d*, which protrude radially to the outside with regard to the bolt axis on diametrically opposed sides. Projections 21*d* are provided on their side remote of head 21*a* with an inclined face 21*e* and a cam 21*m*, which form a cross with the T-beam. Projections 21*f* have, on their side opposite 21*a*, faces 21*g*, which are inclined away from head 21*a* toward each other and toward the bolt axis. Segment 21*c* is adjoined by a neck 21*h*. The neck 21*h* is connected over a collar 21*i* with a circular-cylindrical shaft 21*k*, which forms the end of locking bolt 21 opposite head 21*a*.

Locking bolt 21 can be turned by 90° about its longitudinal axis and is held in plunger guide housing 1 coaxially to the longitudinal axis of the housing. Head 21*a* penetrates through a bore provided in web 1*i* of housing 1 and projects slightly from housing 1. Shaft 21*k* and collar 21*i* protrude into sleeve 19. A compression spring, which bears at one end on collar 21*i* and, at the other end on housing 1, is arranged on shaft 21*k*, and forms the return spring 23 for plunger 11 and admits bolt 21 at the same time with such a force that the T-beam of section 21*c* is pressed on web 1*i* of housing 1.

Inside of housing 1, and behind one or more of the openings 1*c*, a second locking element 25 is arranged and consists of a bent-off spring steel wire. One end of locking element 25 is secured on a part of housing 1. The other end protrudes under elastic initial stress into a first groove provided on the outside of sleeve 13, which forms a closed track. The sleeve 13 is designed so that plunger 11, starting from its rest position in which it projects from dish 1*d*, is brought into its working position by pressing it down, and can be locked in this position. By pressing it down further, plunger 11 can then be unlocked again, so that it is moved back into its rest position by return spring 23. Sleeve 13, however, has, in addition to the first groove forming a closed track, a second groove separated from the first groove by a fin.

The end of second locking element 25 engaging the first groove can be brought with a tool, for example, a thin pin, through opening 1*c* over the fin from the first groove into the second groove. The second groove is designed so that the locking element cannot lock. Naturally, the locking element, or more accurately, its free end, can be brought back again from the second groove into the first groove. The pushbutton switch can thus be used selectively as a locking switch or as a pushbutton switch. We refer here to U.S. Pat. No. 4,112,277 which shows in more detail the possible design of the locking element and of the grooves.

Two switch or control elements 31 and 51 are secured on plunger guide housing 1, each of which has a control element housing 33, 53, respectively. These are each provided with a pair of ribs forming dovetail grooves 33*a*, 53*a* which are complementary to dovetail guides 1*f*, and are pushed so far on dovetail guides 1*f* that the one end faces of said ribs bear on stop shoulders 1*m*. Guides 1*f* thus form a guideway for receiving the guideway engagement means of grooves 33*a* and 53*a*. The pushbutton control elements 33 and 53, are provided with recesses 33*b* and 53*b*, respectively, in the range of the bottom of the dovetail groove and in the end face of the control elements.

Locking bolt 21 can be turned back and forth between two end positions by 90° in the plunger guide housing, as mentioned above, one of which will be called the holding position, and the other the release position. Projections 21*d* of locking bolt 21 engage the surfaces of recesses 33*b*, 53*b* (which face away from knob 15) in their intermediate position shown in FIG. 2, slightly, and more so in the holding position shown in FIGS. 4 and 5.

Locking bolt 21 is locked in its holding as well as in its release position so that it cannot turn by itself. To realize these lockings or catches, the diagonal dimension of the section 21*c* at a right angle to the rotational axis is slightly larger than the distances of the surfaces, opposite to one another, of the recesses 33*b* and 53*b*, as well as the surfaces, opposite to one another, of the enlargements 1*h*, so that the section 21*c* of the bolt and/or the plunger guide housing 1 and/or the control element housing 33, 53 will be slightly elastically deformed when bolt 21 is rotated from one final position to the other. Control or switch elements 31 and 51 pushed on housing 1 in the direction of motion of plunger 11 are thus held immovably in the assembled state by the interlocking dovetail guides and grooves transverse to the direction of motion of the plunger. Furthermore, they are secured in the assembled state against displacement in the direction of motion of the plunger by stop shoulders 1*m* or eventually the shoulders 1*k* and projections 21*d* of locking bolt 21, whereby the stop shoulders 1*m* or eventually the shoulders 1*k* hinder displacements directed towards the pushbutton i.e. towards the operating side of the plunger and the projections 21*d* hinder displacements in the opposite direction.

Figure 8:
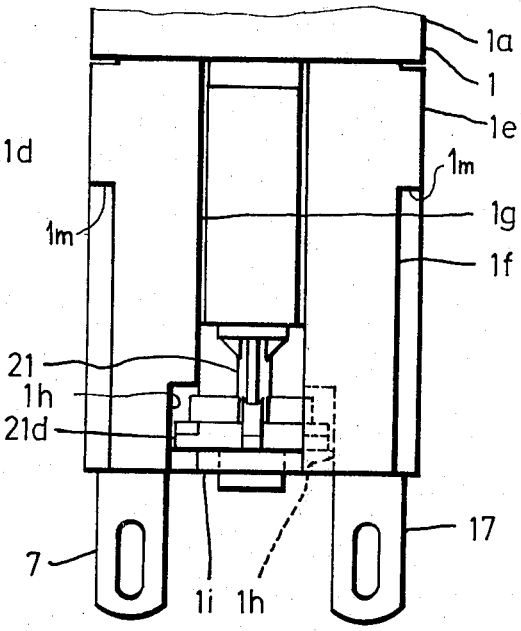
FIG. 8 is a view of the part of the plunger guide housing provided with the dovetail guides and of the plunger and locking bolt arranged therein, in the viewing direction indicated in FIG. 1 by arrow VIII, where the control elements have been removed and the locking bolt in the position in which the control elements are displaceable.

When locking bolt 21 has been turned into its release position shown in FIG. 8, its projections 21*d* protrude into extensions 1*h* and release control elements 31, 51 so that the control elements are displaced along dovetail guides 1*f*, that is, they can be removed or assembled.

Control elements 31 and 51 each have an actuator 35, 55, respectively, which is guided in control element housing 33, 53 straight lined in a right angle to the direction of motion of plunger 11. Actuators 35, 55 are provided on their end section 35*a*, 55*a*, facing sleeve 19 of plunger 11, with a sliding surface 35*b*, 55*b*, which faces pushbutton 15 and is inclined toward the direction of motion of the plunger by about 45°. Each actuator 35, 55 is admitted by a return compression spring 37, 57 acting on it with a force directed toward the longitudinal axis of sleeve 19.

Actuator 35 has a recess which is engaged by a guide rod-type contact 39. The contact 39 is held by partly elastic holding means which are not visible, in such a manner that it jumps in the displacement of actuator 35 from one switching position into the other. Control element 31 has furthermore a pair of fixed contacts 41 and a pair of fixed contacts 43, each of these fixed contacts being connected to a terminal projecting from the control element housing on the side remote of pushbutton 15. The moving contact connects in its two switching positions either the two fixed contacts 41 or the two fixed contacts 43 electrically with each other. We refer here to Swiss Patent No. 547,542, which describes a possible design of the moving contact and of the resilient holding means holding the latter, as well as other details of a similar control element.

Control element 51 is designed similar functionally to control element 31, and differs from the latter in that it has two moving contacts 59, each of which engages a recess of actuator 55. Two fixed contacts 61 and two fixed contacts 63 are assigned to each of the two moving contacts 59. When actuator 55 is displaced, moving contacts 59 jump from one switching position into the other and connect either fixed contacts 61 or fixed contacts 63.

The pushbutton switch can be secured on the front panel of a switchboard or other apparatus with a nut 71 screwed on the male thread 1*b* of plunger guide housing 1, shown only in FIG. 1, where the front panel is then clamped between extension 1*d* and nut 71.

Some details of the operation and assembly of the pushbutton switch will now be described hereinbelow: When the control elements are secured on plunger guide housing 1, actuators 35 and 55 can be moved by means of the plunger 11. When plunger 11 is in its rest position, shown in FIGS. 1 and 3, in which it is not pressed down and does not act on actuators 35, 55, the actuators are likewise held in the rest position by return springs 37, 57.

When plunger 11 is pressed down manually against the force of the return spring 23, so that pushbutton 15 is moved toward control elements 31 and 51, the plunger then arrives in its end position shown in FIG. 4. During this movement, plunger 11 first acts on actuators 35, 55, the rounded transition surfaces at the free end 19*b* of sleeve 19 sliding first along sliding surfaces 35*b* and 55*b*. Actuators 35, 55 are thus pressed away from the plunger axis. The ends of the actuators on which sleeve 19 acts are supported by cams 21*m* of locking bolt 21 on the side opposite this sleeve, which prevents actuators 35, 55 from being tipped by the force component acting on them parallel to the plunger axis. When plunger 11 has reached its end position shown in FIG. 4, the end sections of the actuators bear with their face segments extending parallel to the direction of motion of the plunger on surface segments of sleeve 19 extending likewise parallel to the direction of motion of the plunger. When the locking element engages the first groove of sleeve 13 forming a closed track, plunger 11 slides back a certain amount at first when pushbutton 15 is released, until locking element 25 locks and retains the plunger in this locked position.

In this locked position, actuators 35 and 55 bear either on the surface segments of sleeve 19 extending parallel to the direction of motion of the plunger, or on the outermost part of its rounded transition surfaces, depending on the dimensions of the parts used, that is, on a part of these surfaces which likewise extends substantially parallel to the direction of motion of the plunger, and forms, with the plunger, an angle of not more than about 30°. The forces exerted by return springs 37 and 57 on actuators 35 and 55 in a right angle to the direction of motion of the plunger are thus transmitted to plunger 11 in the locked position of the plunger, but produce in the plunger during the transmission primarily only force components which extend likewise in a right angle to the direction of motion of the plunger. Return springs 37 and 57 thus produce none, or at most relatively weak forces, in the locked position of the plunger, which are directed parallel to the direction of motion of the plunger and which can stress its locking mechanism.

For securing the switch on the front panel of an apparatus or a switchboard, sleeve 1*a* is usually passed through a bore in the respective panel and then clamped by means of nut 71. To ensure that sleeve 1*a* can be passed through such a bore, control elements 31 and 51 must first be removed. Dovetail guides 1*f*, dovetail grooves 33*a* and 53*a*, and locking bolt 21 now permit a very rapid and simple disassembly and assembly of the control elements, a particular advantage being that no separate screws or the like are required. When control elements 31 and 51 are to be removed from plunger guide housing 1, locking bolt 21 is turned by 90° starting from its holding position represented in FIGS. 3 and 4, over the intermediate position represented in FIG. 2 into its release position represented in FIG. 8. In the release position, projections 21*d* no longer protrude into recesses 33*b* and 53*b* of the control element housings, but into extensions 1*h* of plunger guide housing 1.

Control elements 31, 51 are released by locking bolt 21 in its release position and can be removed from plunger guide housing 1 along the dovetail grooves. The inclined faces 21*g* of the locking bolt face actuators 35 and 55 in release position, so that they are pressed away from the plunger axis during the removal and slide smoothly over the web 1*i* of end section 1*e* of housing 1.

When control elements 31, 51 are to be secured again on plunger guide housing 1, they are pushed on dovetail guides 1*f* with locking bolt 21 in release position, until they bear on shoulders 1*k*. Then locking bolt 21 is turned into its holding position in which it prevents displacement of the control elements in a direction away from pushbutton 15.

The pushbutton switch, for instance, can be fitted to a switch board or front plate of any electric instrument. Since all soldering tags, i.e. the lamp terminals 7 and the terminals of the contacts 41, 43 and 61, 63 are placed on the side of housings 1, 33, 53 which is opposite to pushbutton 15, and have the same distance from the switch board or front plate, several pushbutton switches can be fitted close together, it being nevertheless quite easy to solder electric wires to the tags. Moreover, it will be possible to replace a control element quite easily from a switch mounted on the switch board or front plate without having to remove the whole switch.

We will now describe a few possible variations of the pushbutton switch. Here it should be mentioned first that it is naturally possible to secure only one control element or either two control elements 31 or two control elements 51 in plunger guide housing 1 instead of one control element 31 and one control element 51, depending on the number of moving contacts.

It is furthermore possible to replace the dovetail guides 1*f* with T-profiles.

In addition, the two wedge shaped surfaces 21*g* of the locking bolt 21 could be replaced by a conical surface, whose opposite halves perform the task of the surfaces 21*g*.

Furthermore, the actuators of the control elements instead of being guided by parts moving in a straight line transverse to the direction of motion of the plunger, can be replaced by an element moving in a different way, whose end section at the plunger end moves at least substantially in a right angle to the direction of motion of the plunger. For example, actuators could be provided which are formed by levers pivotally mounted in the control element housings.

Naturally, it is not absolutely necessary to design the switch so that it can be used selectively as a locking switch or as a pushbutton switch. The locking mechanism could also be designed, for example, that the switch serves exclusively as a locking switch.

While a specific embodiment of the invention has been shown and described in detail to illustrate the application of the principles of the invention, it will be understood that the invention may be embodied otherwise without departing from such principles.

What is claimed is:

1. A pushbutton switch comprising:

a plunger guide housing having at least one guideway extending in a selected direction along a side of said plunger guide housing;

a plunger displaceable in said plunger guide housing parallel to said selected direction, said plunger having a knob adjacent one end thereof;

at least one switch element having a switch element housing and at least one movable actuator engageable by said plunger to move said actuator with displacement of said plunger from a first position to a second position for switching said switch element, said switch element housing having a portion which is slidably engaged with said guideway in said selected direction and shaped so as to preclude any relative motion of said switch element housing and said plunger guide housing in any direction transverse to said selected direction;

a locking element rotatably mounted to said plunger guide housing on an end thereof remote from said knob and about an axis which is parallel to said selected direction, said locking element being rotatable between a release position disengaged with said switch element housing to permit displacement of said switch element housing with respect to said plunger guide housing in said selected direction and a holding position engaged with the surface of said switch element housing facing away from said knob for preventing motion of said switch element housing at least in a direction away from said knob;

and a restoring spring engaged with said at least actuator to bias said actuator towards said first direction thereof.

2. A pushbutton switch according to claim 1, wherein said plunger guide housing includes a stop engaged with said switch element housing for preventing relative movement of said switch element housing with respect to said plunger guide housing toward said knob.

3. A pushbutton switch according to claim 1, wherein said locking element includes at least one radially extending projection which is engaged with said surface of said switch element housing in said holding position of said locking element.

4. A locking element according to claim 3, wherein said plunger guide housing includes an additional guideway on a side opposite to said first-mentioned guideway, said additional guideway extending parallel to said selected direction, an additional switch element with an additional switch element housing having a portion engaged with said additional guideway for relative motion with said plunger guide housing in said selected direction and to preclude any relative motion in any direction transverse to said selected direction, said additional switch element including an additional actuator engageable with said plunger for movement from a first position to a second position for switching said switch element, said locking element having an additional radially extending projection symmetrical with said first mentioned projection about said axis of rotation of said locking element engageable with a surface of said additional switch element housing facing away from said knob.

5. A pushbutton switch according to claim 1, wherein said plunger guide housing includes a pair of legs which bound an opening and are connected to each other at an end of said plunger guide housing remote from said knob by a web having an aperture therethrough extending in said selected direction, said locking element including a head extending through said aperture and at least one radially extending projection connected to said head and extending into said opening of said plunger guide housing.

6. A push-button switch according to claim 5, wherein said at least one actuator in its first position extends at least partly into said opening between said two legs of said plunger guide housing, said locking element further including at least one side face surface extending obliquely away from said locking element head toward an axis of rotation of said locking element and positioned on said locking element so that, with said locking element in its release position and said at least one switch element being slid in said selected direction away from said knob, said side face surface engages said at least one actuator and moves said at least one actuator toward its second position to remove all of said actuator from said plunger guide housing opening.

7. A pushbutton switch according to claim 6, wherein said projection includes an inclined portion on a surface thereof facing said knob for facilitating engagement of said projection with said switch element housing.

8. A pushbutton switch according to claim 1, wherein said guideway comprises a pair of dove-tail guides defined on a side of said plunger guide housing, said switch element housing portion comprising a groove defined on a side of said switch element housing engaged with said dove tail guides.

9. A pushbutton switch according to claim 1, wherein said locking element is shaped so that said locking element remains without autorotation in said release and holding positions.

10. A pushbutton switch according to claim 1, including electrical lighting means connected to said plunger, an electrical lead connected to said plunger guide housing adjacent an end thereof remote from said knob and engageable with said lighting means when said plunger is moved in said selected direction, and electrical leads connected to said at least one switch element on a side of said at least one switch element remote from said knob.

11. A pushbutton switch according to claim 1, wherein said at least one switch element includes a switch contact engaged with said actuator for movement with said actuator from said first to said second position, said actuator being movable transversely to said selected direction when said actuator is moved by said plunger.

* * * * *